US006246186B1

(12) United States Patent
Nieberger

(10) Patent No.: US 6,246,186 B1
(45) Date of Patent: Jun. 12, 2001

(54) METHOD AND APPARATUS FOR CONTROLLING TWO INDEPENDENT VISUAL INDICATORS WITH A SINGLE OUTPUT PIN

(75) Inventor: Mathew Arthur Nieberger, Rocklin, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/516,059

(22) Filed: Mar. 1, 2000

(51) Int. Cl.[7] ..... G05F 1/00

(52) U.S. Cl. ..... 315/291; 315/169.3; 315/131; 345/46; 345/48; 345/84

(58) Field of Search ..... 315/291, 169.3, 315/306, 131; 345/44, 46, 48, 52, 82, 84

(56) References Cited

U.S. PATENT DOCUMENTS 4,797,556 * 1/1989 Marzari et al. ..... 250/551
5,874,930 * 2/1999 McRobert et al. ..... 345/44
5,959,413 * 9/1999 Komarek et al. ..... 315/306

* cited by examiner

*Primary Examiner*—Haissa Philogene

(57) ABSTRACT

A display apparatus for selectively and independently controlling the illumination of two diode indicator lights with a single control line. The apparatus includes first and second diode indicator means connected in parallel with one another, with the cathode to anode direction of the first diode indicator means being opposite the second diode indicator means. A circuit means is provided which is adapted to selectively provide one of high, low and medium voltage levels on a control output line responsive to combinations of high and low DATA and ENABLE signals. One of the first and second diode indicator means being switched on when the output line voltage level is high, the other being switched on when the voltage level is low and neither indicator means being switched on when the voltage level is medium.

13 Claims, 1 Drawing Sheet

METHOD AND APPARATUS FOR CONTROLLING TWO INDEPENDENT VISUAL INDICATORS WITH A SINGLE OUTPUT PIN

FIELD OF THE INVENTION

The present invention generally relates to a display apparatus, and more particularly to an apparatus for independently controlling two visual indicators with a single output pin of an integrated circuit.

BACKGROUND OF THE INVENTION

In a conventional display apparatus having two independent visual indicators, each indicator is independently driven using separate integrated circuit pins and separate current limiting resistors. This type of conventional display apparatus is undesirable in that it is "pin constrained", i.e., a separate integrated circuit pin is required to drive each of a plurality of display indicators.

Moreover, many conventional display apparatus require a separate current limiting resistor for each independently driven visual indicator. This is also undesirable in that it increases the power consumption required for multiple display indicators.

Accordingly, a primary object of the present invention is to provide an improved display apparatus in which a only single integrated circuit output pin is needed to selectively drive two independent visual indicators.

Another object of the present invention is to provide such an improved display apparatus in which a single current limiting resistor is used to drive two independent visual indicators, thereby reducing the power consumption and size of the display apparatus relative to many conventional display apparatus.

BRIEF DESCRIPTION OF THE DRAWINGS

These and other objects of the invention will be apparent from the following detailed description in connection with the attached drawings, in which.

SUMMARY OF THE INVENTION

Broadly stated, the display apparatus of the present invention includes a pair of indicator lights that are adapted to be selectively turned on and off with a signal level applied on a single line. The ability to control the operation of two indicator lights with a single line minimizes the number of output pins that are used from an electronic integrated circuit compared to many prior art configurations. Moreover, only a single current limiting resistor is needed for two indicator lights which reduces the power consumption compared to some prior art configurations.

DETAILED DESCRIPTION OF THE INVENTION

Figure 1:
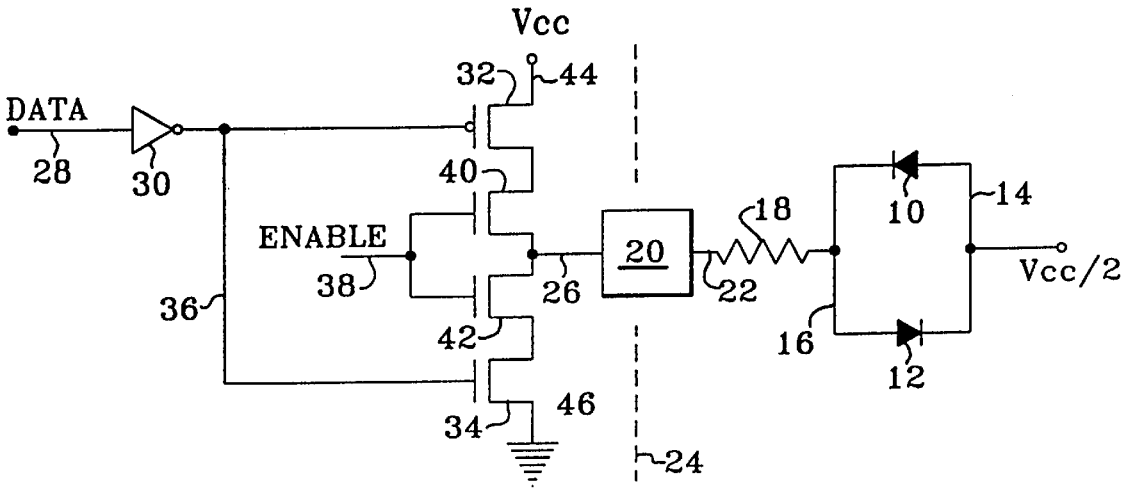
FIG. 1 is a schematic circuit diagram of a display device embodying the present invention; and, FIG. 2 is an alternative embodiment of a portion of the circuit diagram shown in FIG. 1.

A circuit diagram of the preferred embodiment of the improved display device of the present invention is shown in FIG. 1 and includes a pair of visual indicators which are preferably light emitting diodes (LEDs) 10 and 12 that are connected in parallel with the anode of LED 10 connected to line 14 which is connected to the cathode of LED 12 and to a source of voltage Vcc/2. The cathode of LED 10 and anode of LED 12 are connected to line 16 which is connected to a single current limiting resistor 18 which in turn is connected to an IC pad 20 via line 22. The IC pad 20 is preferably a standard output buffer having three output states, which are identified as Drive-High, Drive-Low and Drive-Disable. The output states are preferably approximately at the level of Vcc, Vcc/2 and ground.

Figure 2:
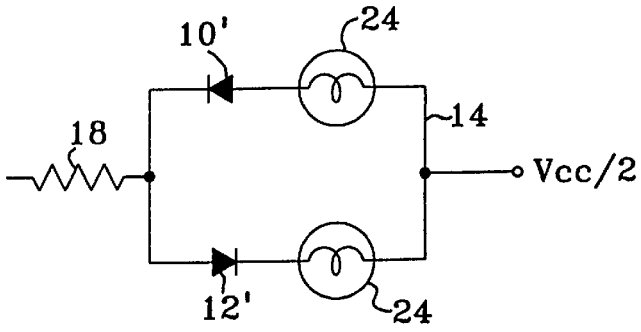

The portion of the circuitry comprising components 10 through 22 are preferably located externally of the portion of the circuitry shown to the left of the line 24. The LEDs 10 and 12 may be separately formed, or may be provided in a single unitary package. However, one of ordinary skill in the art understands that the indicator lights may be formed of a standard diode 10' or 12' connected in series with a lamp 25 as shown in FIG. 2.

In accordance with an important aspect of the present invention, the two LEDs 10 and 12 can be independently controlled by a signal on a single control line 26 that is provided by circuitry indicated to the left of dotted line 24. The circuitry shown is representative of the logic that used in the present invention, and it can be carried out in a microprocessor or other processor or processing integrated circuit, such as an ASIC, for example. It should be understood that such a microprocessor or other device may perform substantial functionality and the visual indicator control represents a very minor part of its overall operation. Because of the many control functions that the microprocessor may carry out, the number of output pins that exist for controlling visual indicator operation may be quite limited, and for that reason, the present invention has a marked advantage over many prior art designs because the present invention can independently and selectively control two visual indicators with a single output pin.

The improved display device of the present invention may be used in any application requiring the independent control of two indicator lights. However, according to a preferred embodiment, the improved display device is incorporated in a print server.

Referring to the left portion of FIG. 1, a DATA signal is applied on line 28 that is connected to an inverter 30 which in turn is connected to transistors 32 and 34 via line 36. Transistor 32 has an inverting input while transistor 34 does not. This results in a high DATA signal switching transistor 32 into conduction and switching transistor 34 off, and a low DATA signal doing the opposite. An ENABLE signal is applied to line 38 that extends to transistors 40 and 42 both of which are connected to control line 26. As shown, transistor 40 is connected to transistor 32 and transistor 42 is connector to transistor 34. Transistor 32 is connected to a voltage source Vcc via line 44 and transistor 34 is connected to ground via line 46. The transistors shown in FIG. 1 are illustrated to be CMOS transistors, but it should be understood that other types of transistors or other configurations of logic elements could be used to carry out the operation of the present invention, i.e., to provide the signals on control line 26 that will be hereinafter described.

The operation of the circuitry shown in FIG. 1 can be understood from the state table shown below in Table 1.

TABLE 1

| DATA | ENABLE | D10 | D12 | PAD STATE |
|---|---|---|---|---|
| "don't care" | LOW | OFF | OFF | Disable-Drive |
| LOW | HIGH | ON | OFF | Drive-LOW |
| HIGH | HIGH | OFF | ON | Drive-HI |
| CLOCK | HIGH | ON | ON | Drive-HI, Drive-LOW |

When the ENABLE signal on line 38 is low, transistors 40 and 42 are switched to an off state, and neither of the LEDs 10 and 12 is illuminated regardless of the level of the DATA signal on line 28. Thus, a DATA "don't care" condition occurs when the ENABLE signal is low.

When the ENABLE signal on line 38 is high, transistors 40 and 42 are switched to an on state, and a selected one of the LEDs 10 and 12 is illuminated depending on the state of the DATA signal on line 28. Thus, for the remaining state conditions in Table 1, the ENABLE signal is high.

When the DATA signal 28 is low, transistor 34 is switched into conduction and current flows through transistors 42 and 34 to ground. This places IC pad 20 at its low output level and line 22 will preferably be approximately at ground. Consequently, LED 10 will illuminate because the voltage on line 22 is less than the voltage Vcc/2 provided on line 14 which forward biases LED 10 into conduction.

Similarly, when the DATA signal is high (and ENABLE signal is high), transistor 32 is switched into conduction (and transistor 34 is switched off) so that current flows from the Vcc source via line 44 through transistors 34 and 40 thereby placing control line 26 to a high level of Vcc minus any parasitic resistance. This causes the IC Pad 20 to provide a high level on line 22 which forward biases LED 12 into conduction. This occurs because the voltage Vcc on line 22 is greater than the voltage Vcc/2 on line 14.

It should be appreciated from that both LEDs 10 and 12 may not be simultaneously illuminated due to their opposite biasing in circuit. However, as a result of the human eye's persistence of vision, both LEDs 10 and 12 will appear to be simultaneously illuminated if the DATA signal on line 28 is toggled between it high and low values at a sufficiently high rate. Thus, for example, if the DATA signal is toggled high and low at a rate of 60 Hz, it will appear that both LEDs 10 and 12 are simultaneously illuminated. However, the power consumption will not exceed that of a single conventional display device. It should be also understood that the DATA and ENABLE signals can be controlled to keep the intensity or brightness of the LEDs 10 and 12 relatively constant between the three DATA states, with this done by driving the ENABLE signal with the clock signal when the DATA signal is in either its high or low state.

From the foregoing, it should be appreciated that an improved display apparatus has been shown and described which offers many advantages and desirable attributes compared to prior art display devices. The present invention conserves utilization of precious output pins of integrated circuits, in that it can selectively and independently control two visual displays with a single output pin. The circuit design of the present invention is compact in size, elegant in its simplicity and operation, and miserly in its power consumption.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. Apparatus for selectively and independently controlling the illumination of two diode indicator lights with a single control line, said apparatus comprising:

first and second diode indicator means connected in parallel with one another with the cathode to anode direction of the first diode indicator means being opposite the second diode indicator means;

circuit means adapted to selectively provide one of high, low and medium voltage levels on a control output line responsive to combinations of high and low DATA and ENABLE signals;

one of said first and second diode indicator means being switched on when said output line voltage level is high, the other being switched on when said voltage level is low and neither indicator means being switched on when said voltage level is medium.

2. Apparatus as defined in claim 1 further comprising:

a single current limiting resistor operably connected to said control output line and to a first end of said first and second diode indicator means; and, a voltage source having said medium voltage level connected to a second end opposite said first end of said first and second diode indicator means.

3. Apparatus as defined in claim 1 wherein each of said first and second indicator means comprises a light emitting diode.

4. Apparatus as defined in claim 1 wherein each of said first and second indicator means comprises a diode and a lamp connected in series.

5. Apparatus as defined in claim 2 wherein said circuit means comprises means for providing a clock signal having a predetermined frequency, said circuit means being adapted to alternate said output line voltage between any two of said high, low and medium voltage levels at said predetermined frequency.

6. Apparatus as defined in claim 5 wherein said predetermined frequency is approximately 60 Hertz, said circuit means alternating said output line voltage between said high and low voltage levels to thereby provide the appearance of both said first and second indicator lights being illuminated.

7. Apparatus as defined in claim 6 wherein said circuit means alternating said output line voltage between one of said high and low voltage and said medium voltage level to provide a predetermined intensity of illumination.

8. Apparatus as defined in claim 1 wherein said circuit means provides a medium voltage level when said ENABLE signal is low, irrespective of the level of said DATA signal.

9. Apparatus as defined in claim 1 wherein said circuit means provides one of a high and low voltage level when said ENABLE signal is high and said DATA signal is low.

10. Apparatus as defined in claim 1 wherein said circuit means provides one of a high and low voltage level when said ENABLE signal is high and said DATA signal is high.

11. Apparatus for selectively and independently controlling the illumination of two light emitting diodes (LEDs) with a single control line, said apparatus comprising:

first and second LEDs connected in parallel with one another with the cathode of each being connected to the anode of the other;

circuit means adapted to selectively provide one of high, low and medium voltage levels on a control output line responsive to combinations of high and low DATA and ENABLE signals;

a current limiting resistor being connected to said circuit means and to the cathode of said first LED, the anode of said first LED being connected to a source of medium voltage;

one of said first and second LEDs being switched on when said output line voltage level is high, the second LED being switched on when said voltage level is low and neither LED being switched on when said voltage level is medium.

12. Apparatus as defined in claim 11 wherein said first and second LEDs are contained in a common package.

13. Apparatus as defined in claim 11 wherein said circuit means further comprises an output buffer with the output buffer providing said control output line.

* * * * *